US006773236B2

(12) United States Patent
Arbuckle

(10) Patent No.: US 6,773,236 B2
(45) Date of Patent: Aug. 10, 2004

(54) INTERNALLY PRESSURIZED DIAPHRAGM POSITIVE DISPLACEMENT PUMP

(76) Inventor: Keith L. Arbuckle, 123 Gladiola Ct., O'Fallon, MO (US) 63366

( * ) Notice: Subject to any disclaimer, the term of this patent is extended or adjusted under 35 U.S.C. 154(b) by 7 days.

(21) Appl. No.: 10/222,030

(22) Filed: Aug. 16, 2002

(65) Prior Publication Data

US 2003/0039563 A1 Feb. 27, 2003

Related U.S. Application Data

(60) Provisional application No. 60/312,832, filed on Aug. 16, 2001.

(51) Int. Cl.[7] ..... F04B 17/00
(52) U.S. Cl. ..... 417/53; 417/413.1; 92/96
(58) Field of Search ..... 417/413.1, 53, 417/412, 480; 92/48, 49, 50, 34, 42, 96, 97, 100

(56) References Cited

U.S. PATENT DOCUMENTS 4,090,286 A * 5/1978 Sepso ..... 29/454
4,286,932 A * 9/1981 Nagano et al. ..... 417/526
4,773,832 A * 9/1988 Muck ..... 417/474
4,898,200 A * 2/1990 Odajima et al. ..... 137/85
5,009,580 A * 4/1991 Maru ..... 417/533

* cited by examiner

*Primary Examiner*—Justine R. Yu
*Assistant Examiner*—Han L Liu
(74) *Attorney, Agent, or Firm*—Lathrop & Gage LC

(57) ABSTRACT

This disclosure relates to a highly durable positive displacement pump capable of dry-priming and pumping of a liquid containing abrasive non-soluble material. The pump assembly comprises an internally pressurized diaphragm assembly secured to a pump bowl and a pump bowl tube. A suction inlet and discharge outlet are located at opposite ends of the pump bowl tube, the inlet and outlet are each configured to receive a valve that limits flow of the liquid to a single direction. The internally pressurized diaphragm assembly comprises an upper diaphragm positioned atop a lower diaphragm wherein a cavity is formed between the diaphragms that is pressurized thereby reducing fatigue failure inducing stresses. Reciprocating axial movement of the internally pressurized diaphragm assembly, produced by a drive means, suctions the liquid in through the suction inlet and then discharges the liquid through the discharge outlet.

31 Claims, 4 Drawing Sheets

INTERNALLY PRESSURIZED DIAPHRAGM POSITIVE DISPLACEMENT PUMP

RELATED U.S. APPLICATION DATA

This application is a non-provisional application which claims the priority of prior provisional application Serial No. 60/312,832 entitled "Positive Displacement Pump" filed Aug. 16, 2001, which is hereby incorporated by reference into this application.

BACKGROUND

Wastewater liquids flowing into treatment plants consist of approximately 98% by volume soluble and 2% non-soluble mixture. The 2% non-soluble portion causes the major problems found in liquid pumping applications for wastewater treatment plants. Common pumps used in these treatment plants are centrifugal and positive displacement type pumps.

A centrifugal pump operates on the principle of adding energy to the liquid by an impeller revolving at between 750 and 3000 revolutions per minute. Wear and premature failure of the volute and impeller is created by grit impacting those components at high velocity. Stringy materials in the wastewater regularly become wrapped around centrifugal pump impellers which can stop the pump or greatly reduce pump flow. This type of pump is also limited to flooded suction conditions and must be protected from running dry such as when emptying a tank. Mechanical seals or packing is required to prevent leakage of the pumped liquid from exiting through the rotating shaft and casing. Another disadvantage of centrifugal pumps is that because flow is not proportional to pump speed an external flow meter is required to vary flow rates.

Current diaphragm pump designs utilize a single diaphragm that is deflected by means of a piston or rod attached to the center. The problem with this design is the diaphragm must be able to withstand continuous differential forces acting on the diaphragm material. When the diaphragm moves to the up stroke position, the forces acting on the underneath side of the diaphragm is low and most likely a vacuum or negative pressure is created. The diaphragm material must resist imploding and is in a compressive state.

Once the stroke is reversed and begins moving down, the diaphragm must overcome the discharge pressure. The forces acting on the bottom of the diaphragm are positive and the diaphragm material must resist expansion and is in a state of tension. The greater the discharge pressures the greater the differential forces on the diaphragm material. For example, if the pump is operating at 300 strokes per minute at a discharge pressure of 25 psig and is under a suction lift of 2 psig, then the diaphragm material will see a pressure swing of 27 psig every one fifth of a second. This causes fatigue on the material which leads to failure due to tearing of the material.

The larger the diaphragm and the higher the discharge pressure the shorter the life expectancy of the diaphragm. For this reason the size of the diaphragm for rod driven diaphragm pumps is kept small in size and less than a 1" stroke length. Increasing the thickness of the diaphragm to increase discharge pressure will also increase the diaphragm's rigidity causing the same failure. Decreasing the thickness adds flexibility but decreases the pump performance for discharge pressure. The present invention is based upon the operating principle of gas, which being compressible, acts according to the formula $P_1V_1=P_2V_2$.

There are two types of positive displacement pumps. The first is a close tolerance pump that relies upon close fitting parts to displace a volume fluid by means of a piston, gear, or progressive cavity. These pumps are highly susceptible to wear caused by grit. As the tolerances diminish between the moving parts, flows will also decrease and the pump speed must be increased to compensate for the loss. This in turn accelerates the deterioration of the pump until the flow is below required performance for the application. Rags are also concern because pump failures occur from them becoming lodged in between the rotor and stator. This pump is also limited to flooded suction conditions and must be protected from running dry such as when emptying a tank. Mechanical seals or packing is required to prevent leakage of the pumped liquid from exiting through the rotating shaft and casing. The footprint of the pump is large in relation to the performance requiring a larger area for installation than other types of pumps.

The other type of positive displacement pump is a diaphragm pump. Its principle of operation is to displace volume by a diaphragm in a reciprocating motion. In order for liquid to move in one direction by the displaced volume, check valves are required. Check valves are located on the inlet and discharge side of the pump. This type of pump has limited flow rates and discharge pressures due to the design of the diaphragm. The use of a single diaphragm greatly limits the size and displacement stroke due to the need of flexibility for movement and rigidity for creating the discharge pressure. The reciprocating motion also imposes differential pressures on the diaphragm material ranging from a negative pressure on the up stroke to a reversing situation on the down stroke, which is a positive pressure. This is a limiting factor due to the cause of diaphragm failure and thus limits the applications for its use. Also, the check valves are an essential component for the workings of the pump. If a check valve fails to seat properly, then all flow is stopped. Stringy material and grit are common causes of this problem and are high maintenance for treatment plant operators.

A positive displacement pump utilizing diaphragms and check valves can be utilized in many applications beyond simply treatment plants, however, treatment plants have particularly aggressive environments that can cause rapid failure of equipment. Development and production of pumps capable of extended life at treatment plants will undoubtedly create demand for similar types of long lived, scalable pumps in other industrial settings.

For the foregoing reasons, there is a need for a scalable pump capable of moving liquids with non-soluble constituent that is not subject to failure based upon the abrasive effects of the non-soluble components or the damaging effects of stringy and cloth type materials.

SUMMARY

The present invention is directed to a positive displacement pump that satisfies this need of providing a pump capable of withstanding the damaging effects of liquids containing grit and fiber that cause rapid wear in centrifugal and close tolerance positive displacement pumps. In addition, the present invention is directed to a positive displacement pump that satisfies the need of minimizing the deleterious effects of rapid pressure reversals on the diaphragms that are utilized in these pumps.

A pump apparatus having features of the present invention comprises an internally pressurized diaphragm assembly positioned atop and secured to a pump bowl. When the pump bowl is flooded with a liquid the internally pressurized diaphragm assembly is capable of applying a negative pressure to the liquid at the suction inlet and a positive pressure to the liquid at the discharge outlet. Check valves positioned within the suction inlet and discharge outlet restrict movement of the liquid to a single direction such that during a diaphragm up-stroke, when negative pressure is applied, the liquid is drawn into the pump bowl from the suction inlet, however, liquid cannot be drawn back in from the discharge outlet because check valve restricts the flow. When the internally pressurized diaphragm undergoes a down-stroke and the assembly produces a positive pressure, the liquid is forced into the discharge outlet. This liquid, however, cannot escape back through the suction inlet under positive pressure because the check valve restricts flow to a single direction.

The internally pressurized diaphragm assembly is comprised of an upper and lower diaphragm preferably comprised of nitrile utilizing a reinforced vulcanized nylon mesh or similarly elastic yet durable material, an upper diaphragm plate positioned atop the upper diaphragm along with a lower diaphragm plate positioned beneath the lower diaphragm. The diaphragms are secured, in an air-tight fashion, to the pump bowl proximate to their outer periphery with the aid of an outer diaphragm ring and a spacer ring. The upper and lower diaphragm plates have a smaller diameter than the upper and lower diaphragms and when secured in position leave exposed an annular portion of the upper and lower diaphragm. The annular portion is further defined by the laterally outward projection of the annular portion of the upper and lower diaphragms resulting in an internal cavity.

The cavity of the diaphragm can be pressurized by means of a valve or other mechanism to a predetermined level. The pressurization of the annular cavity diminishes the damaging effect of the differential forces acting on the diaphragm assembly. Positive displacement pumps utilizing a single unpressurized diaphragm are especially susceptible to premature failure as the diaphragm is subject to negative pressure (compression) when in the up-stroke position and positive pressure (tension) when in the down-stroke position. Rapid fluctuations in these countervailing pressures during normal operation of a single diaphragm positive displacement pump and the resulting diaphragm fatigue are the principal cause of pump failure. The implementation of a pressurized diaphragm assembly eliminates the swing from compression to tension of the upper and lower diaphragms thereby increasing the life expectancy of the pump assembly.

Accordingly, it is the primary object of the present invention to provide a pump that can easily pass solids without clogging, wearing, or causing failure to the moving parts exposed to the liquid being pumped. Another object of the present invention is to enable operation without damage during run dry conditions, such as draining a tank. A still further object of the present invention is to eliminate the need for mechanical seals or packing. A still further object of the present invention is to produce flow rates proportional to pump speed in order to maintain a desired flow rate that is linearly adjustable by changing rotating speed up to the design requirements of the application. A still further object of the present invention is to maintain a desired flow rate without variations due to discharge pressures up to the design requirements of the application. A still further object of the present invention is for all wearing parts to be easily accessible for maintenance. A still further object of the present invention is operation with low shear conditions for liquid solution passing through pump.

Additional objects and advantages of the invention are set forth in part in the description which follows, and in part will be obvious from the description, or may be learned by practice of the invention. The objects and advantages of the invention will be realized and attained by means of the elements and combinations particularly pointed out in the appended claim.

Figure 1:
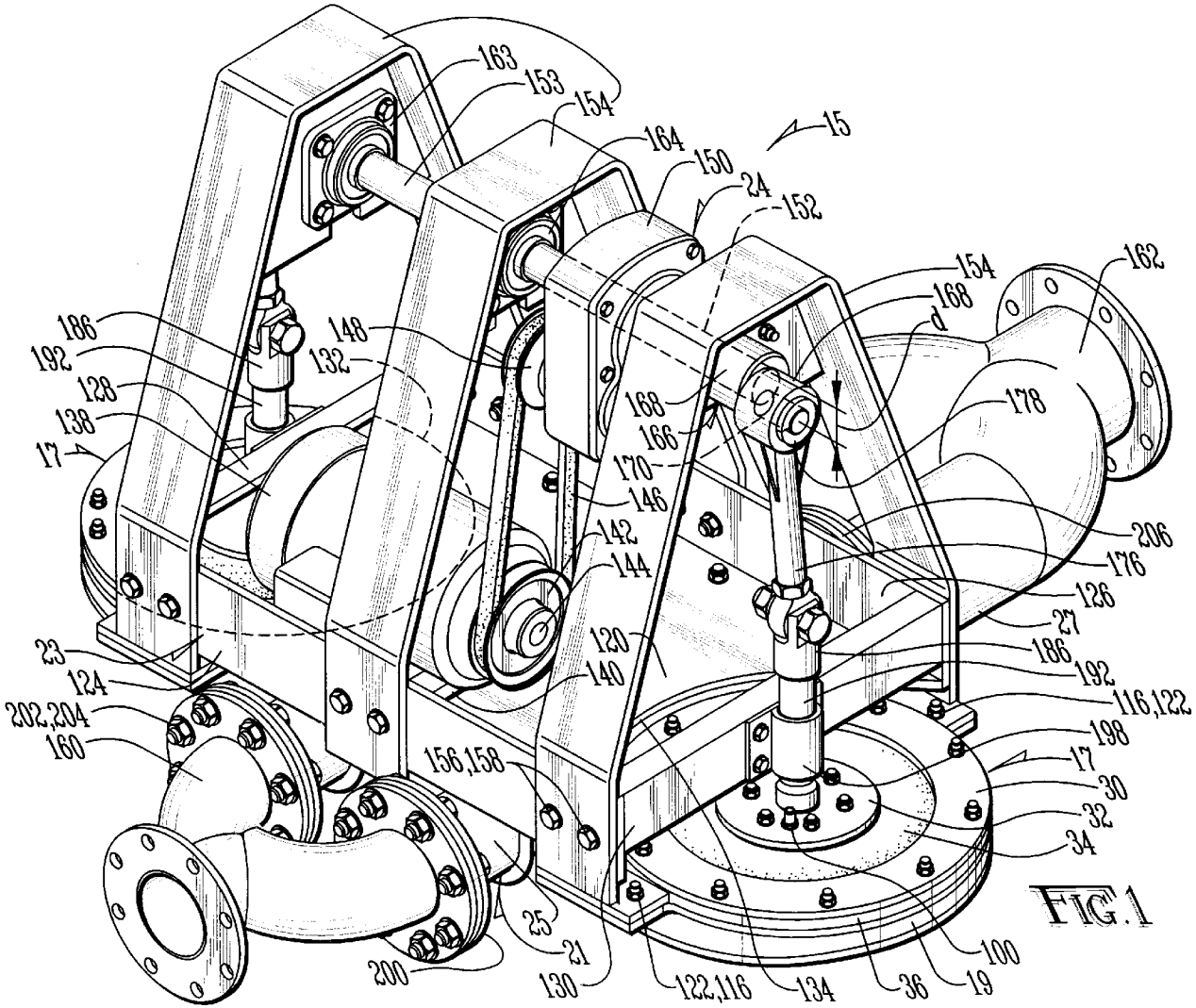
FIG. 1 shows a pictorial view of an embodiment of the invention.

While the invention is susceptible of various modifications and alternative constructions, a certain illustrated embodiment has been shown in the drawings and will be described in detail below. It should be understood, however, that there is no intention to limit the invention to the specific form disclosed, but on the contrary, the intention is to cover all modifications, alternative constructions, and equivalents falling within the spirit and scope of the invention.

DESCRIPTION

The term "liquid" as used throughout this document is defined more broadly than the traditional definition of liquid which is defined by Wordsmyth Dictionary as meaning "consisting of molecules that move easily, unlike those of a solid, but tend not to separate, as do those of a gas." In the context of this invention the term liquid is defined as possibly containing some percentage of solids. The solids in this context may be dirt, grit, sand, rocks, textiles, cellular material and many other type of non-soluble materials that are suspended in the easily moving molecules that do not tend to separate.

The term "scalable" as used throughout this document means a component or the pump itself that can be expanded to meet future needs.

Figure 2:
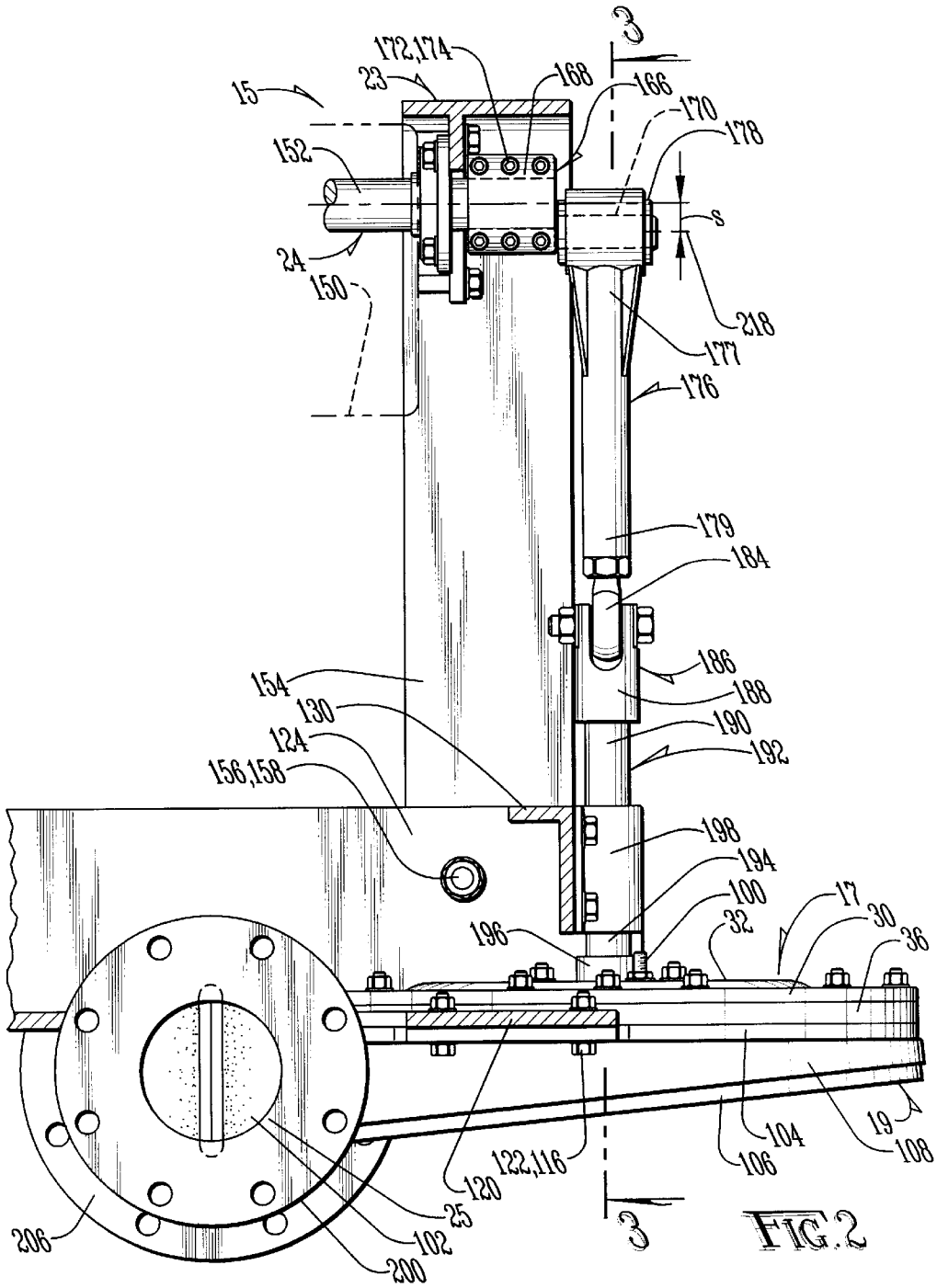
FIG. 2 shows an enlarged detail side view of the pump bowl, pump bowl tube, a portion of the drive means, the internally pressurized diaphragm assembly and a check valve.
Figure 3:
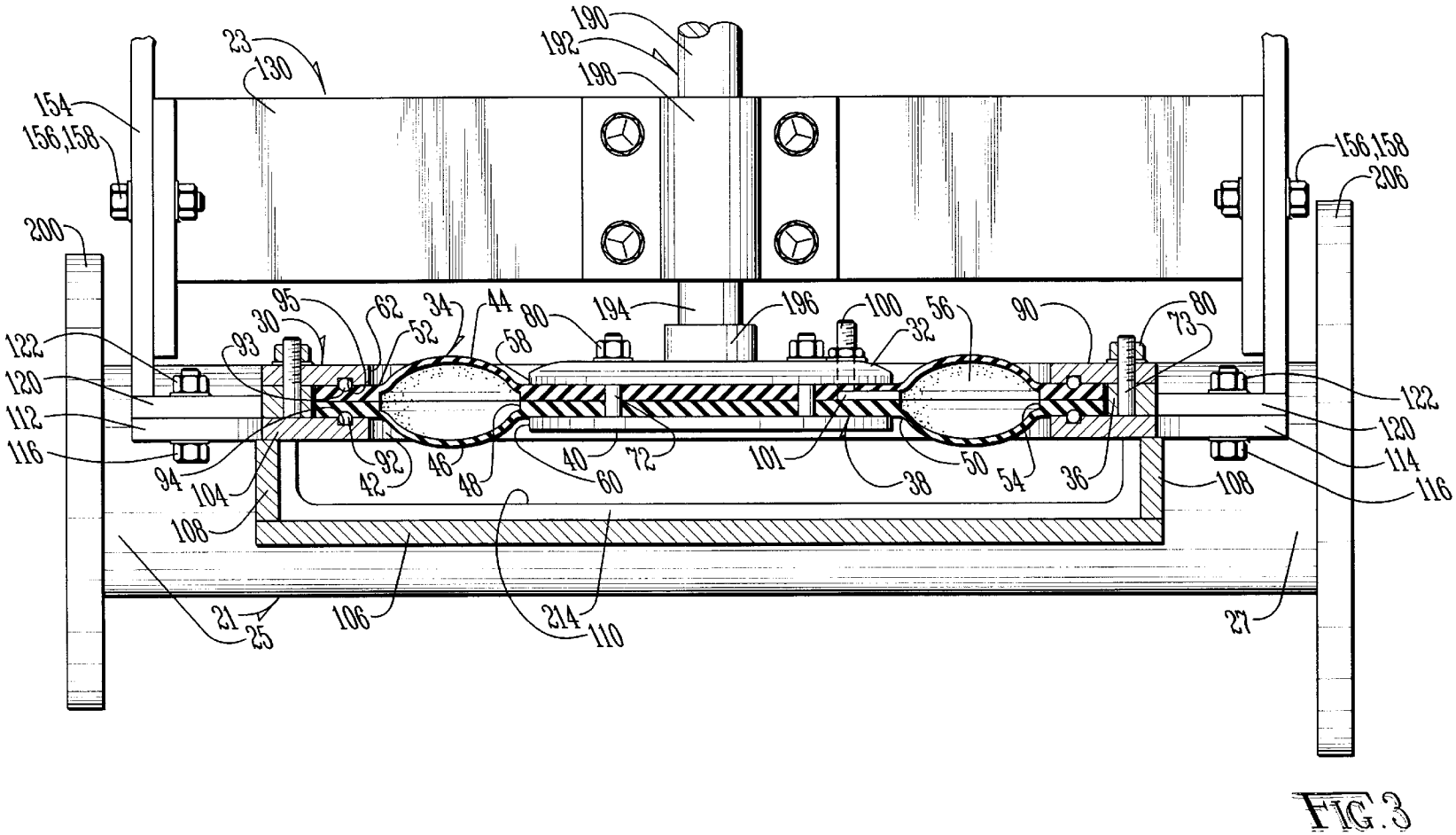
FIG. 3 shows a sectional view of the pump taken generally along lines 3—3 in FIG. 2.

As is shown in FIG. 1, an internally pressurized diaphragm positive displacement pump 15 comprises an internally pressurized diaphragm assembly 17, a pump bowl 19 connected to a pump bowl tube 21, a base frame 23 and a drive assembly 24 for producing reciprocating axial motion of the diaphragm assembly and thereby pumping a liquid. As shown in FIG. 2, the internally pressurized diaphragm 17 assembly is mounted atop the pump bowl 19 and is driven in a reciprocating fashion by the drive means. When in operation, the pump bowl, and pump bowl tube, are flooded with a liquid that is drawn in through a suction inlet 25 and discharged through a discharge outlet 27 as shown in FIG. 3. The suction inlet and discharge outlet are positioned at opposite ends of the pump bowl tube 21. The pump bowl and pump bowl tube are secured to the base frame which also provides a rigid foundation for the drive 24.

Figure 4:
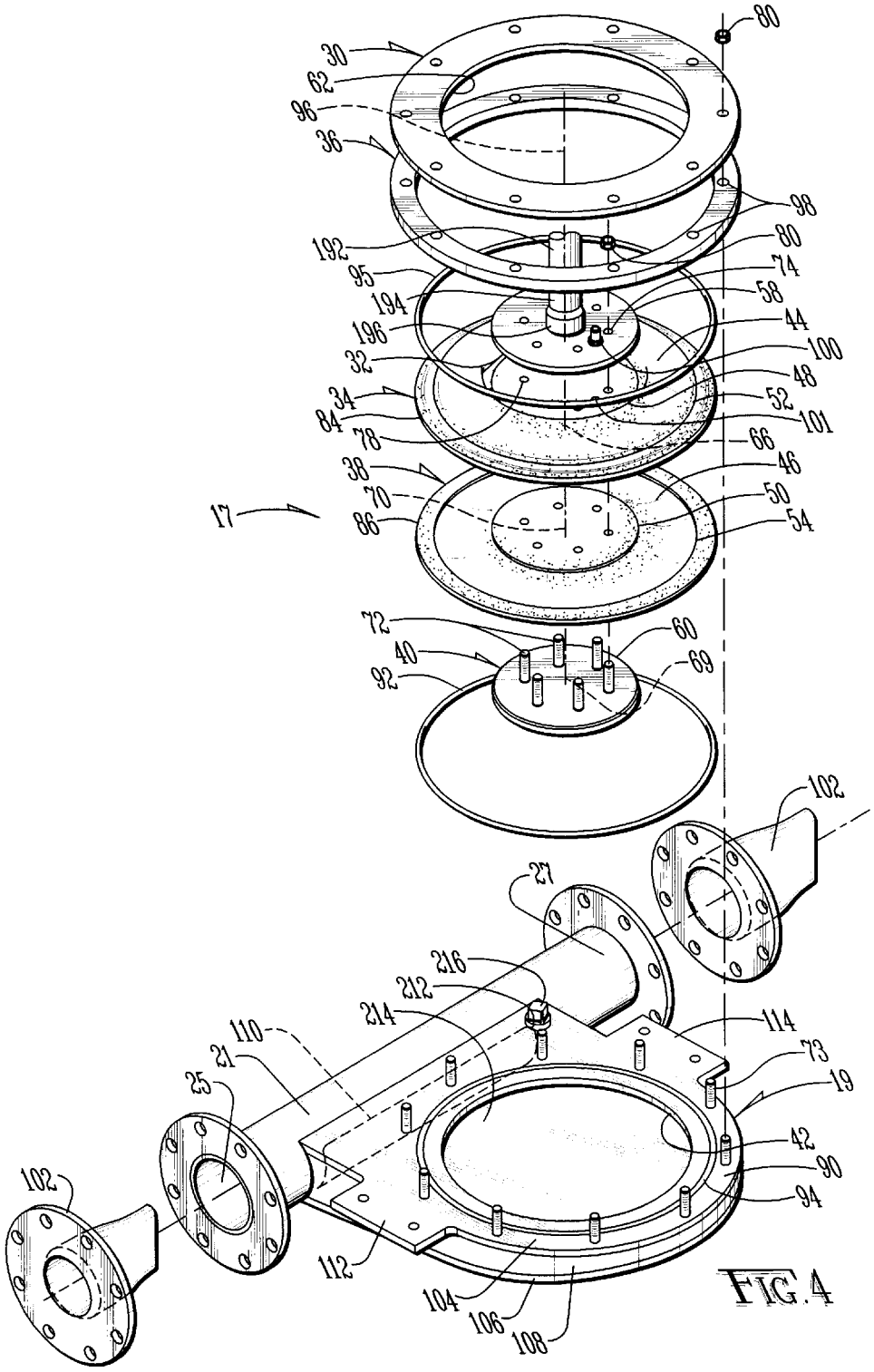
FIG. 4 is an exploded view of an embodiment of the invention.

As shown in FIG. 4 the internally pressurized diaphragm assembly 17 comprises an outer diaphragm ring 30, an upper diaphragm plate 32, an upper diaphragm 34, a spacer ring 36, a lower diaphragm 38 and a lower diaphragm plate 40. The entire assembly is mounted to an opening 42 in the pump bowl 19. The upper and lower diaphragms 34,38 are preferably circular in shape and are preferably comprised of nitrile utilizing a reinforced vulcanized nylon mesh or another suitably flexible yet highly durable material. Circular diaphragms, as opposed to other configurations, avoid the formation of stress concentrations or a non-uniform distribution of stresses that could lead to premature failure of the assembly. An example of a preferred nitrile diaphragm utilizing a vulcanized nylon mesh is manufactured by Coastcraft Rubber Company of 23340 South Normandie Ave, Torrance, Calif.

The upper and lower diaphragms include oppositely laterally extending portions 44,46 with an inner annular perimeter 48,50 and an outer annular perimeter 52, 54. When the upper diaphragm 34 is placed atop the lower diaphragm 38 and secured to the pump bowl 19 the oppositely extending annular portions form a cavity 56 as shown in FIG. 3. The extent of the annular portion of the upper and lower diaphragms is further defined by the placement of the upper and lower diaphragm plates 32, 40 which will be discussed in greater detail below. The outer circumference 58, 60 of the upper and lower diaphragm plates rest adjacent the inner perimeters 48, 50 of the annular portions 44, 46 of the upper and lower diaphragm 34, 38. The outer perimeters 52, 54 of the annular portions 44, 46 of the upper and lower diaphragms 34, 38 is bounded by the inner circumference 62 of the outer diaphragm ring 30 utilized in securing the diaphragms 34, 38 to the pump bowl 19.

The upper diaphragm plate 32, which is preferably manufactured from series 304 stainless steel to resist corrosion, is positioned atop the upper diaphragm 34 such that a central axis 66 of the upper diaphragm and the central axis 68 of the upper diaphragm plate are coincident. Likewise, the lower diaphragm plate 40 is positioned beneath the lower diaphragm 38, extending downward into the pump bowl 19. The central axis 69 of the lower diaphragm plate 40 is also coincident with the central axis 70 of the upper and lower diaphragms 34, 38 and the upper diaphragm plate 32. The lower diaphragm plate 40, which is also preferably manufactured from 304 stainless steel, has a series of threaded risers 72 extending upwardly that coincide with holes 74 in the upper diaphragm plate. The threaded risers are also preferably series 304 stainless steel and extend through preformed holes 78 in the upper and lower diaphragms 34,38. Series 304 stainless steel nuts 80 threaded onto the risers 72 are preferably utilized to secure the various component into a unified assembly.

The upper and lower diaphragms 34,38 are secured to the pump bowl 19 proximate to their outer circumferences 84, 86 by nuts 80 applied to a series of equally spaced threaded stainless steel risers 73 extending from the pump bowl upper surface 90 through preformed holes in the outer diaphragm ring 30 and the spacer ring 36. Series 304 stainless steel is preferred for the risers 73 and the nuts 80 because of the steel's resistance to corrosion and its ready commercial availability. A lower O-ring 92 and an upper O-ring 93 are positioned respectively in a preformed groove 94 of the upper surface 90 of the pump bowl 19 and in a preformed groove 95 in the lower surface of the outer diaphragm ring 30 to facilitate the formation of a watertight seal and to prevent slippage of the upper and lower diaphragms 34, 38 when the pump is in operation. The O-rings, which are preferably of a non-compressible material, bite into the outer circumference of the upper and lower diaphragms when pressure is applied by the nuts 80 threaded onto the risers 73. This biting action significantly reduces the prospect for slippage of the diaphragms during operation of the diaphragm assembly. A spacer ring 36 with a central axis 96 coincident with the upper and lower diaphragms is also positioned between the upper and lower diaphragms proximate the outer circumference 84,86 of the upper and lower diaphragms. The spacer ring 36 has preformed holes 98 aligned with threaded risers 73 extending from the upper surface 90 of the pump bowl 19. When positioned between the upper and lower diaphragms and secured in position by the outer diaphragm ring 30 and nuts 80 threaded on the risers 73, the spacer ring 36 serves to facilitate the formation of a watertight and air tight seal between the diaphragms and the spacer ring. The spacer ring is preferably formed from nylon or some other suitably malleable non-metallic material that will assist in the formation of a seal capable of withstanding the pressures produced by the pump.

As discussed above, the diaphragm annular cavity 56 is formed from the laterally extending portions 44, 46 of the upper and lower diaphragm 34, 38. To maximize the desired operational longevity of the pump the annular cavity 56 must be pressurized. A check valve 100 positioned atop the upper diaphragm plate 32 and extending through the upper diaphragm 34 provides a means for pressurizing the assembly to a pressure which is preferably in the range of 20 to 30 psig. As seen in FIG. 3, a chase 101 is preferably cut into the upper diaphgram 34 to provide an unobstructed path for air entering through the check valve 100 to flow into the cavity 56. The precise cavity 56 pressure will, however, be determined by the particular pumping application. Pressurization of the cavity 56 places the upper and lower diaphragms under a persistent tension load that varies in magnitude when the pump is operating. Maintaining the diaphragms under a tension, albeit a varying tension, as opposed to a cyclical tension-to-compression loading serves to increase the longevity of the diaphragms.

The internally pressurized diaphragm pump assembly 17 described above is mounted atop the pump bowl 19. The liquid contained within the pump bowl serves as the reservoir upon which the diaphragm assembly operates. When the diaphragm assembly 17 is moving in an up stroke, the liquid contained in the pump bowl 19 and pump bowl tube 21 is experiencing a reduction in pressure thereby causing more liquid to be pulled in through the suction inlet 25. As the diaphragm assembly undergoes a downstroke the liquid contained in the pump bowl 19 and tube 21 experiences an increase in pressure. This increase in pressure causes the liquid in the pump bowl and tube to be forced out through the discharge outlet 27. Liquid flow is controlled to a single direction by the use of check valves 102. Check valves 102 are positioned within the suction inlet 25 and attached to the discharge outlet 27 of the pump bowl tube limiting movement of the liquid to one way. An example of a preferred check valve is the TideFlex® Series 35 Flanged check valve manufactured by the Red Valve® Company of 700 North Bell Ave., Pittsburgh, Pa.

As seen in FIG. 4, the pump bowl 19 is constructed of a top 104, a bottom 106, and a side pattern 108 that defines the separation between the top 104 and the bottom 106 of the pump bowl. The pump bowl top 104 and bottom 106 are preferably constructed of one-half inch thick series 304 stainless steel while the side pattern 108 is preferably constructed of one-quarter inch thick series 304 stainless steel. The pump bowl side pattern 108 is pressed into the desired shape to fit the pump bowl and is preferably welded to the pump bowl 19 and the pump bowl tube 21 forming a water and air-tight seal. The pump bowl tube 21 is also preferably constructed of schedule 40, series 304 stainless steel with a portion of the tube cutout 110 to allow the liquid to move freely between the suction inlet 25, the tube 21, the pump bowl 19 and the discharge outlet 27.

As previously discussed, a series of threaded risers 73 extend upwardly from the pump bowl 19 upper surface 90.

The threaded risers 73 are for securing the internally pressurized diaphragm assembly into position. In addition, two flanges 112, 114 extend outwardly from the pump bowl upper surface 90 for securing the pump bowl 19 to the base frame 23. As shown in FIG. 2, the pump bowl 19 is preferably secured to the base frame 23 by bolts 116 passed through the bottom panel 120 of the base frame 23 and into the flanges 112, 114 of the pump bowl and tightened into position with nuts 122.

The base frame 23 is also preferably constructed of plates and angle iron of one-half inch thick series 304 stainless steel. The base frame 23 is comprised of a bottom panel 120, two side panels 124, 126 and two angle iron ends 128, 130. The angle iron ends, as will be discussed in more detail later will serve to support the linear bushing which is instrumental in providing the reciprocating motion to the diaphragm assembly. As shown in FIG. 1, the base frame bottom panel 120 also has two opposed arcuate cut-outs 132, 134 proximate to the angle irons to facilitate positioning and operation of the diaphragm assembly 17. The base frame bottom panel 120, side panels 124, 126 and angle iron ends 128, 130 are preferably welded together to provide a rigid foundation for the drive assembly 24.

As depicted in FIG. 1, the drive assembly 24 produces a reciprocating axial movement of the internally pressurized diaphragm assembly 17 causing movement of the diaphragms from a first position to a second position or alternatively from an "up" position to a "down" position causing a displacement "d." The diaphragm assembly 17 is driven by a motor 138, preferably a totally enclosed, fan cooled, variable speed electric motor. A variable speed motor allows the user to control the flow of liquid being moved by the pump. A totally enclosed motor is protected from corrosive liquids and possible electrical short circuits through exposure to liquids while the fan provides the motor with its own temperature control mechanism. An example of such a preferred motor is the ten (10) horsepower, Model No. 4TEC 0100T manufactured by AAA Electric. Many types of rotary power may, however, be successfully employed by the pump 15 including other types of electrical motors or motors powered by gasoline, natural gas or diesel fuel. The drive motor 138 is preferably housed within the base frame 23 and is positioned atop the bottom panel 120 where it is secured to a base frame side panel 124 with a motor mount 140.

A pulley 142 attached to the motor's shaft 144 turns a no-slip drive belt 146 which in-turn spins a pulley 148 coupled to a gear reducer 150. The gear reducer 150 decreases the number of revolutions per minute actually applied through the remainder of the drive system to the internally pressurized diaphragm assembly 17. The gear reducer 150 while reducing the number of revolutions per minute increases the gear reducer drive shaft 152 torque output. An example of a preferred gear reducer is Model No. DID 309, of the Aurora Product Line manufactured by AA International. This preferred gear reducer provides a 9 to 1 reduction in revolutions. The gear reducer 150 is suspended in position over the base frame 23 by a series of support weldments 154 that are secured to the base frame 23 by bolts 158. The support weldments 154 support not only the gear reducer 150, but also the drive shaft 152 that extends from the gear reducer 150. The support weldments 154 can be constructed of any structurally rigid metal, however, aluminum and stainless steel are preferable because of the metals' tensile strength and corrosion resistance.

Preferably extending from opposite ends of the gear reducer 150 are drive shafts 152, 153 that provide rotational power that ultimately is converted to reciprocating linear movement to power the diaphragm assembly 17. Two drive shafts 152,153 are required because in the preferred embodiment there are at least two identical diaphragm assemblies 17 positioned over identically configured pump bowls 19 that are in turn connected to pump bowl tubes. The suction inlets 25 and discharge outlets 27 of the individual pump bowl tubes 21 are united into a single suction inlet and discharge outlet by way of a suction inlet manifold 160 and a discharge outlet manifold 162.

The gear reducer drive shafts 152, 153 are supported in position as they pass through the support weldments by bearing assemblies 164 mounted on the support weldments 154. After passing through the bearing assemblies 164, the gear reducer drive shaft 152 is connected to an eccentric pump 166. The eccentric pump 166 comprises a collar 168 for grasping the gear reducer shaft 152 and a crank 170 emanating from the collar that is offset from the center of rotation of the gear reduction drive shaft 152. As seen in FIG. 2, the eccentric pump collar 168 is preferably of a split configuration, or two piece design, and is secured in position with staggered nuts 172 and bolts 174. A pump rod 176 with a first end 177, a second end 179 and with an internal bearing 178 in the first end 176 is mounted on the crank of the eccentric pump 166. As the shaft 152 emanating from the gear reducer 150 rotates it turns the crank 170 of the eccentric pump 166. The crank 170 of the eccentric pump 166 turns off-center from the gear reducer shaft 152 producing rotation of one end of the pump rod 176, however, because of the internal bearing 182 the second end 180 of the pump rod 176 remains in a near vertical alignment as the first end 178 rotates about the crank 170 of the eccentric pump 166.

The second end 179 of the pump rod 176 is pivotally connected to a first end 184 of a connecting bracket 186. The second end 188 of the connecting bracket 186 opposite the pump rod 176 is connected to a first end 190 of a diaphragm rod 192. The second end 194 of the diaphragm rod 192 is connected to the upper diaphragm plate 32 through a threaded fitting 196 thereby completing the linkage of mechanical power from the motor 138 to the diaphragm assembly 17.

In order to eliminate lateral forces from acting on the diaphragm rod 192 at the point of connection 196 to the upper diaphragm plate 32 the rod 192 is inserted through a close tolerance linear bushing 198. The linear bushing 198 serves to eliminate the side loading on the diaphragm assembly that can accelerate fatigue failure of the diaphragms themselves.

In order to operate the fully assembled pump 15 it is provided with a suction inlet for the supply of liquid and the line through which the liquid is to be discharged. Prior to installing the pump 15 in-line with the supply, the pump should be appropriately sized for the demands of the application. As previously discussed, and as depicted in FIG. 1, at least two side-by-side diaphragm assemblies suctioning from a common manifold 160 and discharging to a common manifold 162 are preferred. The dual pumping action reduces the pulsating effect of liquid being discharged from a single diaphragm assembly pump reducing the fatigue loading on the welded pipe assemblies and thereby prolonging pipe life.

The diaphragm assemblies can, and preferably should be, configured to operate 180 degrees out of phase with one another. Utilizing this approach, one of the diaphragm assemblies moves from an upper first position to a second downstroke position creating pressure on the liquid contained in the pump bowl 19 and the pump bowl tube 21 and forcing the liquid out through the check valve 102 on the discharge side of the pump bowl tube. Liquid cannot be forced back into the suction inlet 25 as the suction inlet check valve restricts flow to a single direction. After reaching the downstroke position the same diaphragm assembly reverses direction and begins to ascend returning to the first position. This movement creates a reduction in pressure, or a suction, pulling the liquid in from the suction inlet through the check valve. Liquid cannot be pulled back through the discharge outlet during this movement as the discharge side check valve 102 restricts flow to a single direction. The adjacent pump diaphragm assembly is moving in exactly the opposite direction of the first, or as discussed above, is 180 degrees out of phase with the adjacent diaphragm assembly.

This countervailing diaphragm assembly movement leads to liquid being continuously suctioned from the supply line and being continuously discharged to the discharge outlet. To accomplish the synchronous displacement of the liquid from the adjacent pump 15 the eccentric crank 170 on the eccentric pump collar 168 for each pump 15 should be placed as close to 180 degrees out of phase with one another before being secured in position with the aid of the pump collar nuts 172 and bolts 174.

The pump 15 is capable of being dry primed, such that liquid need not reside in the pump bowl 19 or the pump bowl tube 21 prior to commencement of the pumping operation. Dry priming, however, is less efficient than priming the pump and to eliminate the inefficiencies associated with dry priming, a fill hole 212, as shown in FIG. 4, is placed through the pump bowl upper surface 90 leading into the interior 214 of the pump bowl 19 for manually filling the bowl and the tube 21. Once the interior 214 is filled, the hole 212 is sealed with a threaded plug 216. The plug 216 maintains the integrity of the system eliminating avenues for air or liquid to escape other than through the discharge outlet 27. One significant advantage of the present invention over prior designs is that no damage to the pump's components will occur in the event the suction inlet runs dry. A lack of liquid in the pump bowl and pump bowl tube will only cause the pump to move air to the discharge outlet and will not damage the diaphragms, the drive motor, eccentric pump, pump rod or diaphragm rod.

As shown in FIG. 1, the suction inlet connection flange 200 is coupled with a series of nuts 202 and bolts 204 to the supply line. Likewise, the discharge outlet line is connected to the discharge outlet connection flange 206 with a series of nuts 208 and bolts 210. Next, the motor 138 is connected to an electrical power supply, or in the event that a fossil fueled motor powers the pump, the appropriate fuel is supplied.

When the pump 15 is in position, appropriately braced, and connected to the supply and discharge lines, and power has been supplied, the pump is ready to begin operation either in a dry prime mode or with priming of the pump bowl through the fill hole 212. Application of power to the motor 138 causes the motor's shaft 144 to turn which causes the drive belt 146 to rotate. The rotating no-slip drive belt turns a pulley 148 on the gear reducer 150. The gear reducer decreases the number of rotations, preferably by a ratio of about 9 to 1. The gear reducers opposed shafts 152, 153 are supported by bearings 164 attached to support weldments 154. The rotating gear reducer shafts run to their respective eccentric pumps 166 where the conversion of the rotational power to reciprocating axial energy commences.

The eccentric pump with its offset motion drives the pump rod 176 which is pivotally connected to the diaphram rod 192. The diaphragm rod 192 which is restrained by a linear bushing 198 to undergo purely axial movement drives the internally pressurized diaphragm assembly 17 in a reciprocating motion with a stroke length determined by the distance "s" the offset of the center of the eccentric pump crank 218 from the center of the gear reducer drive shafts 152, 153. The greater the distance "s" the more displacement of liquid per stoke of the diaphragm assembly. The drawback to greater stoke lengths is the added stress that long strokes place upon the upper and lower diaphragms 34, 38. The optimal offset "s" is best determined by the particular application demands as well as the desired life expectancy of the diaphragms.

Another option to increase the pump output other than increasing the stroke length is to increase the number of reciprocations per unit of time. If the motor 138 utilizes a variable speed controller then the number of cycles per minute can be readily increased or decreased through the electronic controller depending upon the demands of the application. The variable speed motor approach to increasing the pump output is preferable to increasing the stroke length of the diaphragm as it has a less damaging impact upon the diaphragms 34, 38.

The previously described versions of the present invention have many advantages, including providing a pump that can easily pass solids without clogging, wearing, or causing failure to the moving parts exposed to the liquid being pumped. As all of the present invention's moving parts, except the lower diaphragm and lower diaphragm plate, remain unexposed to the abrasive affects of the liquid, the opportunity for accelerated wear on all remaining parts is greatly diminshed. In addition, the internally pressurized diaphragm assembly maintains the individual upper and lower diaphragms in a constant state of tension thereby avoiding the cyclical tension-to-compression cycle that typically produces accelerated fatigue failure of the elastic diaphragms. The invention is capable of moving liquids containing high percentages of solids without clogging and without drastically reducing the output of the pump.

Another advantage of the present invention is to enable operation without damage during run dry conditions. Even when dry pumping, the pump's components do not experience any faster wear then when the pump is pumping liquids. The drive motor, linkage assembly and internally pressurized diaphragm assembly do not experience any additional forces because liquid is unavailable.

A still further advantage of the present invention is that it eliminates the need for mechanical seals or packing. The internally pressurized diaphragm assembly is sealed air and water-tight to the pump bowl with the O-ring, the outer diaphragm ring and the spacer ring assist in the formation of the seal. Any or all of these components are readily replaceable and easily accessible. The components can be repaired or replaced with basic tools and without expert knowledge that is many times required for repairing other pumps.

A still further advantage of the present invention is the pump's ability to produce flow rates proportional to pump speed in order to maintain a desired flow rate that is adjustable up to the design requirements of the application. The variable speed electric motor provides the user with a considerable range of pumping capacities from zero flow to maximum design capacity and anywhere in between.

A still further advantage of the present invention is its ability to maintain a desired flow rate without variations due to discharge pressures up to the design requirements of the application. If discharge pressures fluctuate between design parameters there will be negligible effects to flow rate.

A still further object of the present invention is operation with low shear conditions for liquid solution passing through pump. Because the pump acts in a positive displacement fashion, rather than utilizing centrifugal forces, the liquid being pumped is not subject to excessive shear loadings. Large solids objects that enter through the suction inlet are pushed under pressure to the discharge outlet without experiencing high impact loading that can serve to degrade the operation of the pump or the material being pumped.

The invention does not require that all the advantages feature and all the advantages be incorporated into every embodiment of the invention.

Although the present invention has been described in considerable detail with reference to certain preferred versions thereof, other versions are possible. For example, a solenoid valve may be utilized as the means for urging the diaphragm assembly from a first position to a second position in-lieu of the motor and linkage means that are set forth above. Therefore, the spirit and scope of the appended claims should not be limited to the description of the preferred versions contained herein.

Any element in a claim that does not explicitly state "means for" performing a specific function, or "step for" performing a specific function, is not to be interpreted as a "means" or "step" clause as specified in 35 U.S.C. § 112, ¶ 6. In particular, the use of "step of" in the claims here is not intended to invoke the provisions of 35 U.S.C. § 112, ¶ 6.

What is claimed is:

1. A pump apparatus for transferring a liquid, the pump apparatus comprising:

(a) an internally pressurized diaphragm assembly disposed atop a pump bowl, when the pump bowl is flooded with a liquid the internally pressurized diaphragm assembly is operably coupled through the liquid to a suction inlet and a discharge outlet;

(b) valves disposed within the suction inlet and discharge outlet to restrict movement of the liquid to a single direction; and (c) means for urging reciprocating axial movement of the internally pressurized diaphragm assembly from a first position to a second position wherein when in the first position the diaphragm assembly produces a negative pressure upon the liquid drawing the liquid through the suction inlet and when in the second position the diaphragm assembly produces a positive pressure upon the liquid forcing the liquid into the discharge outlet.

2. The pump apparatus according to claim 1, wherein the internally pressurized diaphragm assembly comprises an upper diaphragm disposed atop a lower diaphragm, the upper and lower diaphragms each comprising an outer circumference, an axis of rotation, a laterally extending annular portion with an inner and outer perimeter, the laterally extending portion of the upper diaphragm projecting oppositely from the laterally extending portion of the lower diaphragm, the upper and lower diaphragms mounted to the pump bowl proximate the outer circumference of the upper and lower diaphragms.

3. The pump apparatus according to claim 2, wherein the laterally extending annular portion of the upper diaphragm and the oppositely laterally extending annular portion of the lower diaphragm comprises an annular cavity.

4. The pump apparatus according to claim 3, wherein the upper diaphragm includes a means for internally pressurizing the annular cavity.

5. The pump apparatus according to claim 4, wherein the means for internally pressurizing the annular cavity includes a valve.

6. The pump apparatus according to claim 1, wherein the internally pressurized diaphragm assembly further comprises an upper diaphragm plate with an axis of rotation and an outer circumference, an outer diaphragm ring with an axis of rotation and an inner and outer circumference, and a lower diaphragm plate with an axis of rotation and an outer circumference, the upper diaphragm plate disposed above the upper diaphragm, the lower diaphragm plate disposed beneath the lower diaphragm wherein the upper and lower diaphragms and the upper and lower diaphragm plates are secured to one another through attachment means, the axis of rotation of the upper and lower diaphragms being coincident with the axis of rotation of the upper and lower diaphragm plates.

7. The pump apparatus according to claim 6, wherein the outer circumference of the upper diaphragm plate and the outer circumference of the lower diaphragm plate are disposed adjacent to the inner perimeter of the laterally extending portion of the upper and lower diaphragm respectively.

8. The pump apparatus according to claim 6, wherein the inner circumference of the outer diaphragm ring is disposed adjacent the outer perimeter of the laterally extending portion of the upper diaphragm.

9. The pump apparatus according to claim 1, wherein the means for urging reciprocating axial movement comprises:

(a) a drive means; and (b) linkage means for connecting the drive means to the internally pressurized diaphragm assembly.

10. The pump apparatus according to claim 9, wherein the drive means comprises an electric motor.

11. The pump apparatus according to claim 9, wherein the linkage means comprises a non-slip drive belt for operably coupling the drive means to a gear reducer, operably coupled to the gear reducer is an eccentric pump for converting rotational movement to linear movement, the eccentric pump being operably coupled to a pump rod, the pump rod being pivotally connected to a diaphragm rod, the diaphragm rod movement restrained to axial movement by a linear bushing, the diaphragm rod being secured to the upper diaphragm plate of the internally pressurized diaphragm assembly.

12. A method of pumping a liquid comprising the steps of:

(a) providing a suction inlet and a discharge outlet for the liquid;

(b) raising to a first position an internally pressurized diaphragm operably coupled to the suction inlet through the liquid thereby producing a negative pressure to suction the liquid from the inlet;

(c) lowering to a second position the internally pressurized diaphragm operably coupled to the discharge outlet through the liquid thereby producing a positive pressure sufficient to discharge the liquid through the discharge outlet; and (d) limiting the flow of liquid to a single direction.

13. The method of claim 12, wherein the internally pressurized diaphragm further comprises an upper diaphragm and a lower diaphragm connected to a pump bowl proximate to the outer circumference of the upper and lower diaphragm, a cavity disposed between the upper and lower diaphragm and a means for pressurizing the cavity.

14. The method of claim 13, wherein the means for pressurizing the cavity comprises a valve.

15. The method of claim 12, wherein the internally pressurized diaphragm is disposed atop a pump bowl flooded with the liquid communicates with the suction inlet and discharge outlet through a pump bowl tube.

16. The method of claim 12, wherein the upper and lower diaphragm are operably coupled to a second end of a diaphragm rod, a first end of the diaphragm rod operably coupled to a means for urging reciprocating movement.

17. The method of claim 12, wherein the raising and lowering steps further comprise a drive means for repositioning the internally pressurized diaphragm from the first position to the second position.

18. The method of claim 12, wherein the flow limiting step comprises check valves disposed within the suction inlet and discharge outlet.

19. A pump for moving liquid comprising:

(a) an internally pressurized diaphragm means disposed atop a pump bowl, the pump bowl being flooded with the liquid;

(b) a suction inlet and a discharge outlet operably coupled to the pump bowl;

(c) means for reciprocating the internally pressurized diaphragm means from a first position to a second position thereby alternatingly drawing the liquid into the pump bowl from the suction inlet and discharging the liquid from the pump bowl through the discharge outlet;

(d) means for restricting flow of the liquid to a single direction.

20. The pump of claim 19, wherein the pump bowl communicates with the suction inlet and discharge outlet through a pump bowl tube disposed between the suction inlet and the discharge outlet.

21. The pump of claim 19, wherein the means for reciprocating comprises a drive means and a linkage means operably coupling the drive means to the internally pressurized diaphragm means.

22. The pump of claim 19, wherein the internally pressurized diaphragm means further comprises an upper and a lower diaphragm, an upper and lower diaphragm plate, an outer diaphragm ring and a spacer ring, the upper diaphragm plate and the upper diaphragm disposed respectively atop the lower diaphragm and the lower diaphragm plate disposed beneath the lower diaphragm, the spacer ring disposed between the upper and lower diaphragm and the outer diaphragm ring disposed atop the upper diaphragm for mounting the upper and lower diaphragms and spacer ring to the pump bowl.

23. The pump of claim 19, wherein the internally pressurized diaphragm means further comprises means for regulating the pressure between the upper and lower diaphragms.

24. The pump of claim 19, wherein the upper and lower diaphragms are comprised of a neoprene.

25. The pump of claim 19, wherein the means for restricting flow to a single direction comprises a check valve disposed within the suction inlet and the discharge outlet.

26. A positive displacement pump assembly capable of prolonged pumping of a liquid containing a low percentage of abrasive non-soluble material, the pump assembly comprising:

(a) a pump bowl and a pump bowl tube disposed adjacent the pump bowl, the pump bowl tube further comprising an oppositely disposed suction inlet and discharge outlet, the inlet and outlet each configured to receive a valve, the valve limiting flow of the liquid to a single direction;

(b) a pump base frame secured to the pump bowl and pump bowl tube;

(c) an internally pressurized diaphragm assembly mounted atop the pump bowl, the diaphragm assembly further comprising an outer diaphragm ring, a spacer ring, an upper diaphragm plate, an upper and lower diaphragm and a lower diaphragm plate, each with an outer circumference and a center axis of rotation, the spacer ring interposed between the upper diaphragm and the lower diaphragm, the upper diaphragm plate disposed atop the upper diaphragm and the lower diaphragm plate disposed beneath the lower diaphragm, an annular cavity formed between the upper and lower diaphragms, the upper diaphragm ring, upper diaphragm, spacer ring and lower diaphragm secured to the pump bowl adjacent the outer circumferences, a diaphragm rod connected to the upper diaphragm plate;

(d) means for adjusting the annular cavity pressure; and (e) means for urging reciprocating axial movement of the diaphragm rod and the internally pressurized diaphragm assembly.

27. The positive displacement pump assembly of claim 26, wherein the valves are cone valves.

28. The positive displacement pump assembly of claim 26, wherein the upper and lower diaphragms are formed from materials consisting of rubber, neoprene and plastic.

29. The positive displacement pump assembly of claim 26, wherein the means for adjusting the annular cavity pressure comprises a valve.

30. The positive displacement pump assembly of claim 26, wherein the means for urging reciprocating axial movement comprises a motor operably coupled to a linkage means.

31. The positive displacement pump assembly of claim 30, wherein the linkage means comprises a gear reducer operably coupled to an eccentric pump, the eccentric pump being operably coupled to a pump rod, the pump rod being pivotally connected to the diaphragm rod thereby completing the delivery of reciprocating axial movement to the diaphragm assembly.

* * * * *